US010462857B2

(12) United States Patent
Zhou et al.

(10) Patent No.: US 10,462,857 B2
(45) Date of Patent: Oct. 29, 2019

(54) MICROWAVE HEATING DEVICE

(71) Applicants: GUANGDONG MIDEA KITCHEN APPLIANCES MANUFACTURING CO., LTD., Foshan (CN); MIDEA GROUP CO., LTD., Foshan (CN)

(72) Inventors: Jianyi Zhou, Foshan (CN); Yongzhong Zhang, Foshan (CN); Jian Long, Foshan (CN); Bi Zhou, Foshan (CN)

(73) Assignees: GUANGDONG MIDEA KITCHEN APPLIANCES MANUFACTURING CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 454 days.

(21) Appl. No.: 14/865,020

(22) Filed: Sep. 25, 2015

(65) Prior Publication Data

US 2017/0086260 A1 Mar. 23, 2017

(30) Foreign Application Priority Data

Sep. 21, 2015 (CN) ..... 2015 2 0732541 U

(51) Int. Cl.
*H05B 6/64* (2006.01)
*H05B 6/80* (2006.01)

(52) U.S. Cl.
CPC ..... *H05B 6/6414* (2013.01); *H05B 6/6402* (2013.01); *H05B 6/80* (2013.01)

(58) Field of Classification Search
CPC ..... H05B 6/6414; H05B 6/6402
(Continued)

(56) References Cited

U.S. PATENT DOCUMENTS 3,865,097 A * 2/1975 Robinson ..... F24C 15/022 126/191
4,409,453 A * 10/1983 Smith ..... A21B 1/245 219/400

(Continued)

FOREIGN PATENT DOCUMENTS

CN 1136762 C 1/2004
CN 1272578 C 8/2006

(Continued)

OTHER PUBLICATIONS

ISA/CN, Written Opinion and International Search Report for PCT/CN2015/090804 dated Jul. 1, 2016.

(Continued)

*Primary Examiner* — Ibrahime A Abraham
*Assistant Examiner* — Biniam B Asmelash
(74) *Attorney, Agent, or Firm* — Seed IP Law Group LLP

(57) ABSTRACT

The present invention discloses a microwave heating device, including: an oven body provided with a door opening detection switch and a door closing detection switch; a drawer door provided with a door opening touch configuration and a door closing touch configuration, installed on the oven body and movable between an open position and a closed position, wherein when the drawer door is in the open position, the door opening touch configuration touches the door opening detection switch, the door closing touch configuration releases the door closing detection switch; when the drawer door is in the closed position, the door closing touch configuration touches the door closing detection switch, the door opening touch configuration releases the door opening detection switch; a driving device configured to drive the drawer door; a controller configured to communicate with the door opening detection switch, the door closing detection switch and the driving device.

8 Claims, 6 Drawing Sheets

(58) Field of Classification Search
USPC ..... 219/392, 400, 520, 702, 741, 756, 762
See application file for complete search history.

(56) References Cited

U.S. PATENT DOCUMENTS

| | | | | |
|---|---|---|---|---|
| 4,982,063 | A * | 1/1991 | Tsunekawa | E05B 17/22 126/197 |
| 6,333,495 | B1 * | 12/2001 | Park | H05B 6/6417 200/50.12 |
| 7,078,662 | B2 * | 7/2006 | Yoshidome | F24C 15/162 126/340 |
| 7,244,916 | B2 * | 7/2007 | Iwamoto | H05B 6/6402 126/340 |
| 7,414,225 | B2 | 8/2008 | Yoshidome et al. | |
| 7,793,650 | B2 * | 9/2010 | Nishio | F24C 7/08 126/190 |
| 7,834,299 | B2 * | 11/2010 | Claesson | A21B 1/245 126/273 A |
| 8,283,610 | B2 * | 10/2012 | Hirano | F24C 15/18 126/192 |
| 2005/0173399 | A1 * | 8/2005 | Yoshidome | F24C 15/02 219/403 |
| 2007/0278219 | A1 * | 12/2007 | Claesson | A21B 1/245 219/702 |
| 2008/0315739 | A1 | 12/2008 | Hirano | |
| 2009/0200297 | A1 * | 8/2009 | Myoji | F24C 7/087 219/762 |
| 2009/0289057 | A1 | 11/2009 | Yoshidome | |

FOREIGN PATENT DOCUMENTS

| | | | | | |
|---|---|---|---|---|---|
| CN | 201925981 | U | | 8/2011 | |
| CN | 102804915 | A | | 11/2012 | |
| CN | 203469077 | U | | 3/2014 | |
| CN | 203642259 | U | | 6/2014 | |
| CN | 204063178 | U | | 12/2014 | |
| CN | 104566534 | A | | 4/2015 | |
| CN | 205026752 | U | | 2/2016 | |
| GB | 2346056 | A | * | 7/2000 | H05B 6/6417 |
| JP | 03045820 | A | * | 2/1991 | |
| JP | H0345820 | | | 2/1991 | |
| JP | 2010181113 | A | | 8/2010 | |

OTHER PUBLICATIONS

SIPO, Second Notification of Office Action in CN App. No. 201510603634.0 dated Jul. 17, 2017.

* cited by examiner

MICROWAVE HEATING DEVICE

RELATED APPLICATIONS

This U.S. application claims priority and benefits of Chinese Application No. 201510603634.0 and 201520732541.3 filed Sep. 21, 2015. The entire disclosure of which is incorporated herein by reference.

FIELD

Embodiments of the present invention generally relate to a field of electric appliances, and more particularly, to a microwave heating device.

BACKGROUND

A drawer-typed microwave oven in the related art adopts two following methods to detect whether a drawer door is in place: in a first method, it is determined by collecting and calculating an amount of pulse signals in a whole travel; in a second method, it is determined according to an amount of pulse signals collected in a predetermined period. However, the first method is susceptible to an external environment, such as power failure, voltage fluctuation or external signal interference, and then fails, thus resulting in a poor reliability of the drawer-typed microwave oven; the second method increases the load of an electric motor, which makes the electric motor easy to be burned down and damaged and results in a shot working life of the electric motor. In addition, since the electric motor is required to collect and feed back the pulse signals in the above two methods, the electric motor has a complex configuration, a high technological requirement and a quality requirement, thus resulting in a high cost of the drawer-typed microwave oven.

SUMMARY

Embodiments of the present invention seek to solve at least one of the problems existing in the related art to at least some extent. Accordingly, the embodiments of the present invention provide a microwave heating device, which has a reliable detection whether the drawer door is in place, a long working life and a low cost.

Embodiments of the present invention provide a microwave heating device, including: an oven body defining a microwave heating chamber therein and provided with a door opening detection switch and a door closing detection switch; a drawer door provided with a door opening touch configuration and a door closing touch configuration, installed on the oven body and movable between an open position in which the microwave heating chamber is opened and a closed position in which the microwave heating chamber is closed, wherein when the drawer door is in the open position, the door opening touch configuration touches the door opening detection switch and the door closing touch configuration releases the door closing detection switch; when the drawer door is in the closed position, the door closing touch configuration touches the door closing detection switch and the door opening touch configuration releases the door opening detection switch; a driving device configured to drive the drawer door to move between the open position and the closed position, installed on one of the oven body and the drawer door and connected with the other one of the oven body and the drawer door in a drive way; and a controller configured to communicate with the door opening detection switch, the door closing detection switch and the driving device.

With the microwave heating device according to embodiments of the present invention, a position of the drawer door can be detected automatically, and an accuracy of the detection is high. Thus, the drawer door can be opened and closed automatically, and an improved operation reliability can be obtained. In addition, since an electric motor is not required to collect pulse signals, the electric motor having a simple structure and a low cost can be used, and the load of the electric motor is not increased, so that a configuration of the microwave heating device is simplified, a manufacture cost thereof is reduced and a working life thereof is improved.

In some embodiments, a guiding rail is disposed on the oven body, a guiding rail connection plate is disposed on the drawer door, and the guiding rail connection plate is movably fitted with the guiding rail.

In some embodiments, the door opening touch configuration is configured as a position limiting block disposed at the guiding rail connection plate, and the door closing touch configuration is configured as a door hook disposed at the drawer door.

In some embodiments, an interlocking bracket is disposed on the oven body, the door opening detection switch and the door closing detection switch are installed at the interlocking bracket, in which when the drawer door is in the closed position, the door hook is caught on the interlocking bracket; when the drawer door is in the open position, the position limiting block is stopped by the interlocking bracket.

In some embodiments, the door closing detection switch includes a monitoring switch, a primary switch and a secondary switch respectively communicating with the controller, in which when the drawer door is in the closed position, the door closing touch configuration touches the monitoring switch, the primary switch and the secondary switch respectively; when the drawer door is in the open position, the door closing touch configuration releases the monitoring switch, the primary switch and the secondary switch respectively.

In some embodiments, a first primary switch and a second primary switch are provided, the monitoring switch and the first primary switch are disposed at a left side of the oven body, the secondary switch and the second primary switch are disposed at a right side of the oven body, and two door closing touch configurations are provided and disposed at a left side and a right side of the drawer door respectively; when the drawer door is in the closed position, the door closing touch configuration at the left side of the drawer door touches the monitoring switch and the first primary switch respectively, and the door closing touch configuration at the right side of the drawer door touches the secondary switch and the second primary switch respectively; when the drawer door is in the open position, the door closing touch configuration at the left side of the drawer door releases the monitoring switch and the first primary switch respectively, and the door closing touch configuration at the right side of the drawer door releases the secondary switch and the second primary switch respectively.

In some embodiments, the monitoring switch and the first primary switch are disposed horizontally, and the first primary switch is located below the monitoring switch; the secondary switch is disposed vertically, and the second primary switch is disposed horizontally and located below the secondary switch.

In some embodiments, each of the monitoring switch, the primary switch, the secondary switch and the door opening detection switch is configured as a microswitch.

In some embodiments, the driving device includes: an electric motor installed in the oven body and communicating with the controller; a push rod device connected with the electric motor and the drawer door respectively and configured to transform a rotational movement of the electric motor into a linear movement of the drawer door.

In some embodiments, the push rod device includes: a driving pulley and a driven pulley rotatably installed on the oven body respectively, and the electric motor being connected with the driving pulley in a drive way; a push rod drive belt fitted over the driving pulley and the driven pulley, and the electric motor be configured to drive the driving pulley to rotate so as to move the push rod drive belt; a push rod connected with the push rod drive belt and the drawer door and driven by the push rod drive belt to move linearly so as to move the drawer door between the open positon and the closed position.

In some embodiments, the driving device further includes a variable-speed drive assembly and the electric motor is connected with the driving pulley in a drive way by the variable-speed drive assembly.

In some embodiments, the variable-speed drive assembly includes: an electric motor pulley connected with the electric motor in a drive way; a variable-speed pulley connected with the driving pulley in a drive way; a variable-speed drive belt fitted over the electric motor pulley and the variable-speed pulley and driven by the electric motor pulley to rotate the variable-speed pulley.

Additional aspects and advantages of embodiments of present invention will be given in part in the following descriptions, become apparent in part from the following descriptions, or be learned from the practice of the embodiments of the present invention.

BRIEF DESCRIPTION OF THE DRAWINGS

These and other aspects and advantages of embodiments of the present invention will become apparent and more readily appreciated from the following descriptions made with reference to the accompanying drawings, in which.

REFERENCE NUMERALS

Figure 1:
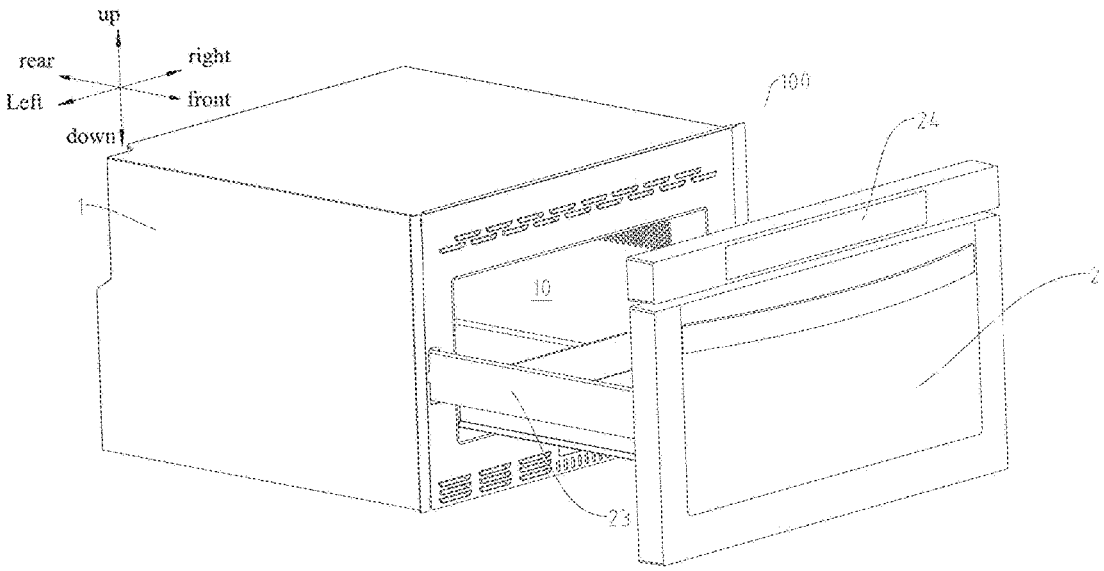
FIG. 1 is a perspective view of a microwave heating device according to an embodiment of the present invention.

Oven body 1, microwave heating chamber 10, door closing detection switch 15, monitoring switch 111, primary switch 112, secondary switch 113, door opening detection switch 12, guiding rail 13, interlocking bracket 14, Drawer door 2, door opening touch configuration 21, door closing touch configuration 22, guiding rail connection plate 23, control panel 24, Driving device 3, electric motor 31, push rod device 32, push rod 321, driving pulley 322, driven pulley 323, push rod drive belt 324, variable-speed drive assembly 33, electric motor pulley 331, variable-speed pulley 332, variable-speed drive belt 333, Transformer 41, capacitor 42, controller 43, Microwave emitter 5, waveguide tube 6, fan assembly 7.

DETAILED DESCRIPTION

Reference will be made in detail to embodiments of the present invention. Embodiments of the present invention will be shown in drawings, in which the same or similar elements and the elements having same or similar functions are denoted by like reference numerals throughout the descriptions. The embodiments described herein according to drawings are explanatory and illustrative, not construed to limit the present invention.

A microwave heating device 100 according to embodiments of the present invention will be described in the following with reference to FIGS. 1-9. The microwave heating device 100 utilizes microwave to heat food, implements an automatic opening or closing of a drawer door, and has a simple configuration, a high reliability and a low cost.

Specifically, the microwave heating device 100 may be a microwave oven or a microwave roaster embedded into a wall or a cabinet.

As shown in FIGS. 1-9, the microwave heating device 100 according to embodiments of the present invention includes: an oven body 1, a drawer door 2, a driving device 3 and a controller 43.

Figure 2:
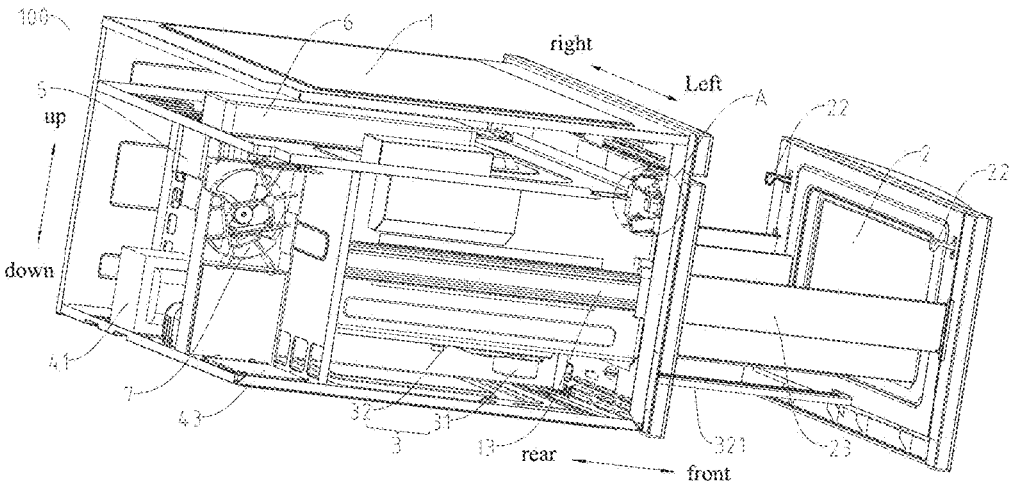
FIG. 2 is another perspective view of a microwave heating device according to an embodiment of the present invention.
Figure 4:
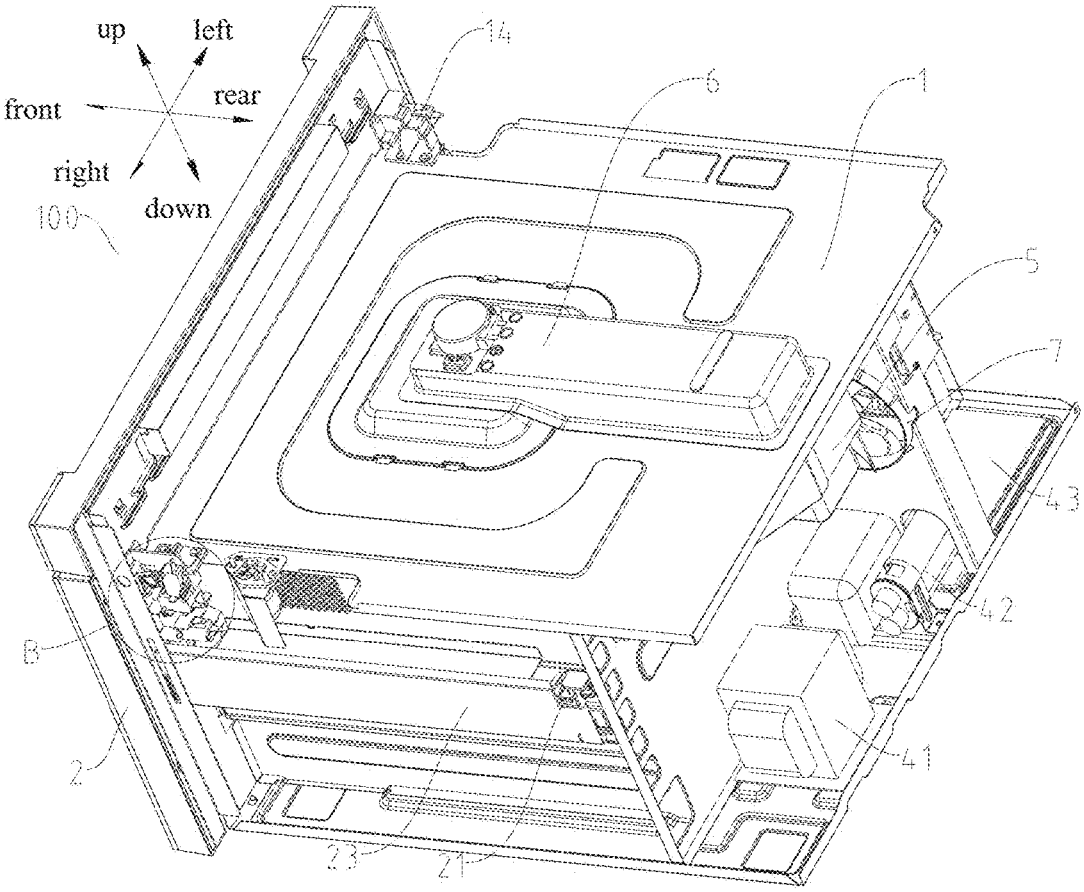
FIG. 4 is a schematic view of a microwave heating device whose drawer door is in a closed position according to an embodiment of the present invention.

The oven body 1 has a microwave heating chamber 10 therein, and the food is heated in the microwave heating chamber 10. The oven body 1 is provided with a door opening detection switch 12 and a door closing detection switch 15. The drawer door 2 is provided with a door opening touch configuration 21 and a door closing touch configuration 22, and the drawer door 2 is installed on the oven body 1 and movable between an open position in which the microwave heating chamber 10 is opened and a closed position in which the microwave heating chamber 10 is closed, and thus it is convenient for a user to put the food into the microwave heating chamber 10 to be heated, or to take the food out of the microwave heating chamber 10. For example, after the food is put into the drawer, the drawer door 2 is moved backwards from the open position as shown in FIG. 2 until the drawer door 2 reaches the closed position as shown in FIG. 4 and the drawer door 2 closes the microwave heating chamber 10 totally, and then the microwave heating device 100 may heat the food. After the heating of the food is finished, the drawer door 2 is moved forwards from the closed position as shown in FIG. 4 until the drawer door 2 reaches the open position as shown in FIG. 2 and the microwave heating chamber 10 is opened to the most extent, and then the food may be taken out.

Figure 5:
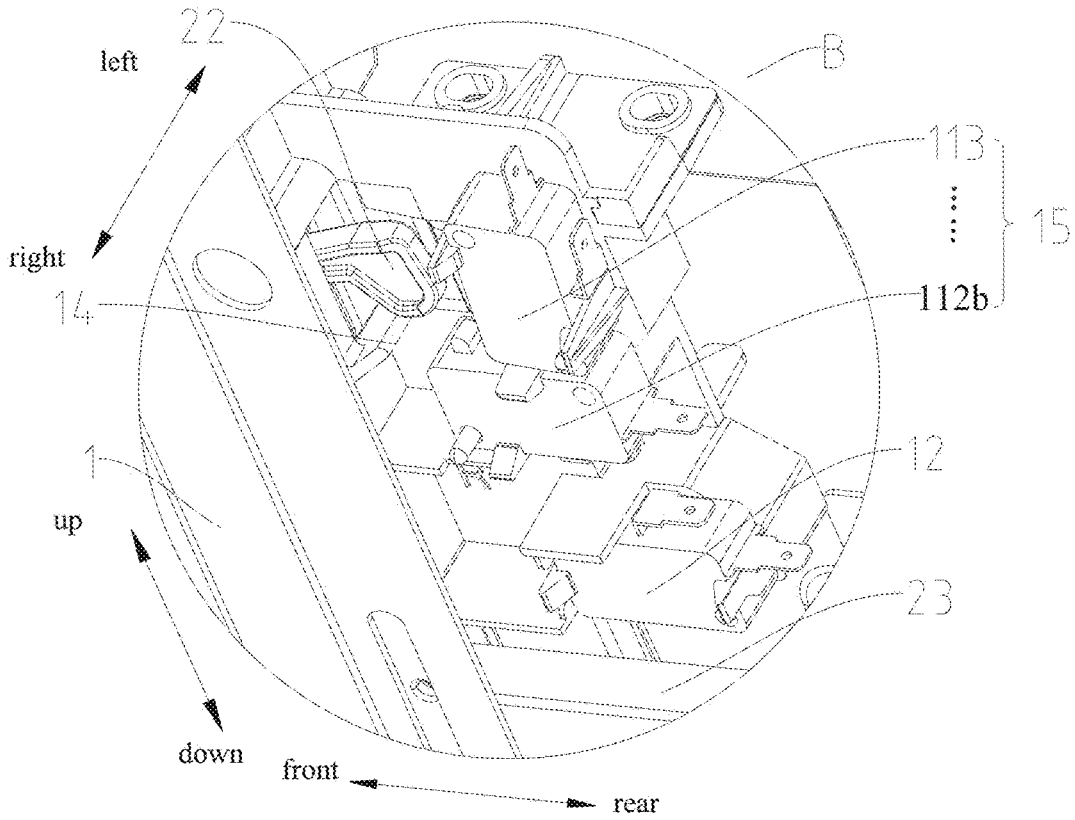
FIG. 5 is an enlarged view of portion B circled in FIG. 4.
Figure 6:
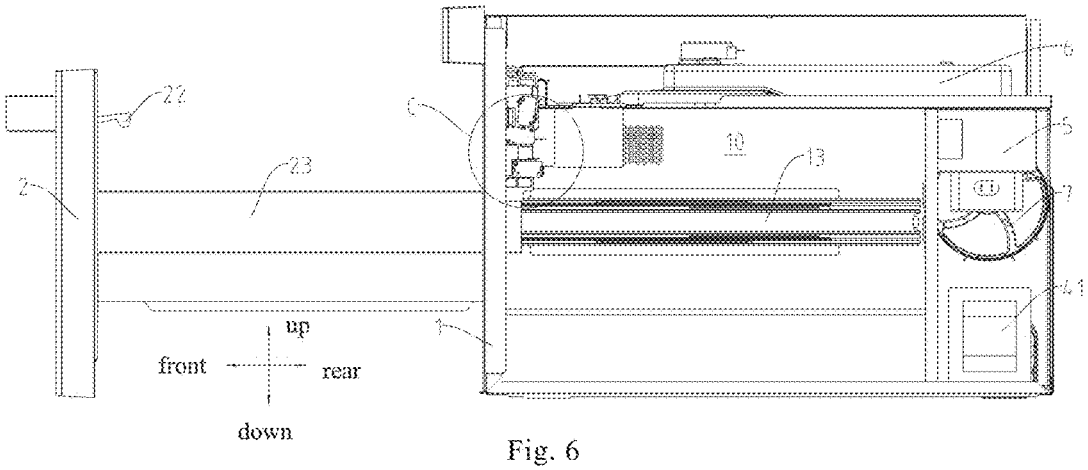
FIG. 6 is a schematic view of a microwave heating device whose drawer door is in an open position according to an embodiment of the present invention.
Figure 7:
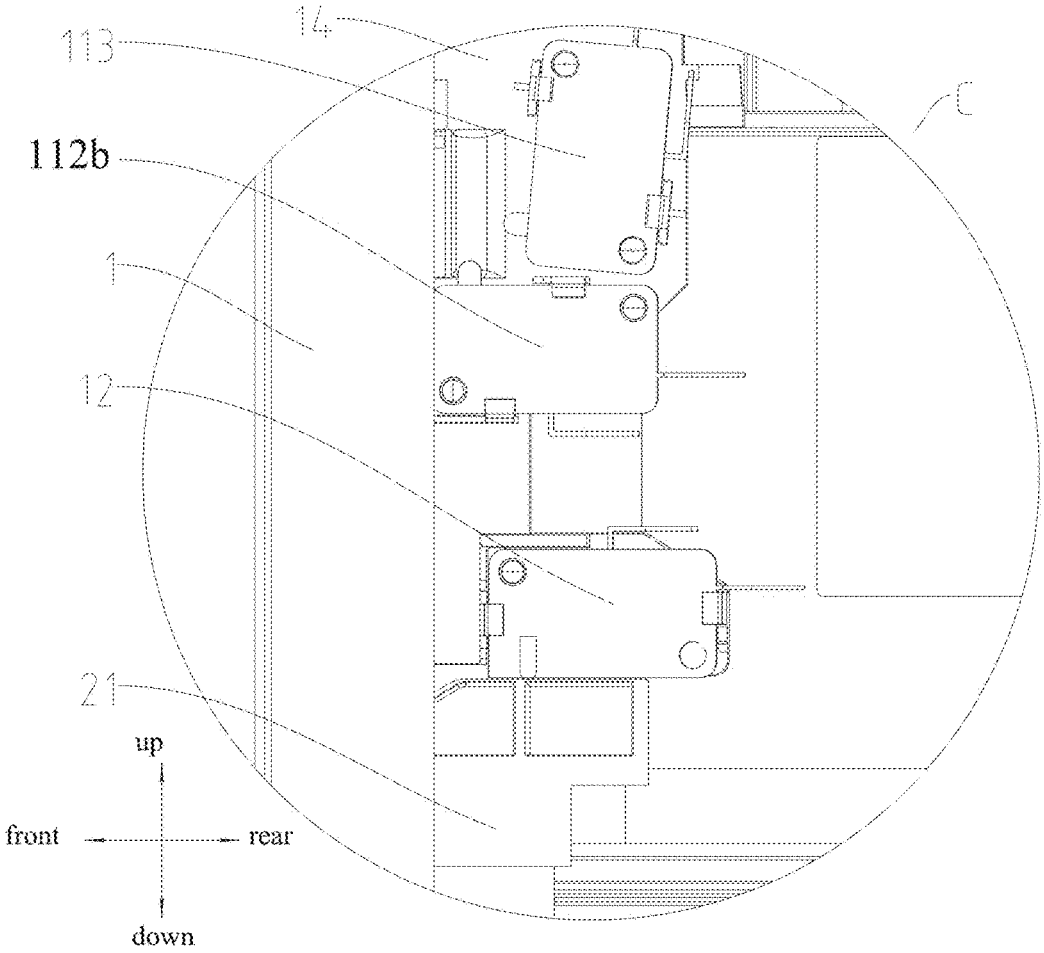
FIG. 7 is an enlarged view of portion C circled in FIG. 6.

As shown in FIGS. 6 and 7, when the drawer door 2 is in the open position, the door opening touch configuration 21 touches the door opening detection switch 12 and the door closing touch configuration 22 releases the door closing detection switch 15. In this way, a position of the drawer door 2 can be detected when the drawer door 2 is in the open position, and an accuracy of the detected position of the drawer door 2 is high. As shown in FIGS. 4 and 5, when the drawer door 2 is in the closed position, the door closing touch configuration 22 touches the door closing detection switch 15 and the door opening touch configuration 21 releases the door opening detection switch 12. In this way, a position of the drawer door 2 can be detected when the drawer door 2 is in the closed position, and an accuracy of the detected position of the drawer door 2 is high.

The driving device 3 is configured to drive the drawer door 2 to move between the open position and the closed position, and the driving device 3 is installed on one of the oven body 1 and the drawer door 2 and connected with the other one of the oven body 1 and the drawer door 2 in a drive way, and thus the driving device 3 can be supported so as to drive the drawer door 2 to move. For example, as shown in FIG. 2, the driving device 3 is installed on a bottom of the oven body 1, and the driving device 3 is connected with the drawer door 2 in the drive way, so that the drawer door 2 can move forwards and backwards, driven by the driving device 3. Certainly, the driving device 3 may be disposed on the drawer door 2 and connected with the oven body 1 in the drive way. It should be noted that, the driving device 3 being connected with the other one of the oven body 1 and the drawer door 2 in the drive way, at least includes a situation in which the driving device 3 can cause a relative movement between the oven body 1 and the drawer door 2.

The controller 43 is configured to communicate with the door opening detection switch 12, the door closing detection switch 15 and the driving device 3 respectively, thus implementing the automatic opening or closing of the drawer door 2.

A process for operating the microwave heating device 100 according to embodiments of the present invention will be described in details in the following with reference to drawings, by an example in which an initial position of the drawer door 2 is the closed position. It may be understood that, at this time, the door opening touch configuration 21 releases the door opening detection switch 12.

When the food needs to be heated, the controller 43 communicates with the driving device 3 and drives the driving device 3 to move the drawer door 2 forwards, and in a forward movement of the drawer door 2, the drawer door 2 gradually opens the microwave heating chamber 10. When the drawer door 2 reaches the open position as shown in FIGS. 2 and 6, the microwave heating chamber 10 is opened to the most extent, the door opening touch configuration 21 touches the door opening detection switch 12, and the door closing touch configuration 22 releases the door closing detection switch 15. In this way, the driving device 3 stops working, and the user can put the food into the drawer. Subsequently, the controller 43 communicates with the driving device 3 and drives the driving device 3 to move the drawer door 2 backwards, and in a backward movement of the drawer door 2, the drawer door 2 gradually closes the microwave heating chamber 10. When the drawer door 2 reaches the closed position as shown in FIG. 4, the microwave heating chamber 10 is closed completely, the door closing touch configuration 22 touches the door closing detection switch 15, and the door opening touch configuration 21 releases the door opening detection switch 12. In this way, the driving device 3 stops working, and then the microwave heating device 100 may heat the food therein. It may be understood that, when the heating of the food is finished, above steps may be repeated to take out the food and then close the drawer door 2.

With the microwave heating device 100 according to embodiments of the present invention, when the drawer door 2 is in the open position, the door opening touch configuration 21 touches the door opening detection switch 12 and the door closing touch configuration 22 releases the door closing detection switch 15; when the drawer door 2 is in the closed position, the door closing touch configuration 22 touches the door closing detection switch 15 and the door opening touch configuration 21 releases the door opening detection switch 12, and thus the position of the drawer door 2 can be detected automatically, and the accuracy of the detection is high, so that the drawer door 2 can be closed or opened automatically. Furthermore, a mechanical detection is used, which is less affected by external factors and has a high working reliability. In addition, since the driving device 3 is not required to collect pulse signals, the driving device 3 having a simple structure and a low cost can be used, and the load of the driving device 3 is not increased, so that a configuration of the microwave heating device 100 is simplified, a manufacture cost thereof is reduced and a working life thereof is improved.

As shown in FIGS. 2 and 6, in some embodiments of the present invention, a guiding rail 13 is disposed at each of a left side and a right side of the oven body 1, and a guiding rail connection plate 23 is disposed at each of a left side and a right side of the drawer door 2, and the guiding rail connection plate 23 is movably fitted with the guiding rail 13, and thus the drawer door 2 can move stably in a front and rear direction.

In some embodiments, as shown in FIGS. 2, 4 and 5-7, the door opening touch configuration 21 may be configured as a position limiting block disposed at the guiding rail connection plate 23, and the door closing touch configuration 22 may be configured as a door hook disposed at the drawer door 2. The position limiting block may be located at a rear end of the guiding rail connection plate 23, so that the drawer can be moved out of the microwave heating chamber 10 to a greater degree, which is convenient for the user to take out and put in the food and ensures that the drawer door 2 can be stably supported on the guiding rail 13 with a large enough opening space of the drawer door 2, thus significantly improving the working life of the drawer door 2 and the guiding rail 13. The door hook is extended backwards from the drawer door 2, so that the microwave heating device 100 can accurately detect the position of the drawer door 2 when the drawer door 2 closes the microwave heating chamber 10 completely.

Furthermore, as shown in FIGS. 2-7, an interlocking bracket 14 is provided on the oven body 1, the door opening detection switch 12 and the door closing detection switch 15 are installed at the interlocking bracket 14. As shown in FIGS. 4 and 5, when the drawer door 2 is in the closed position, the door hook is caught on the interlocking bracket 14, so that it is ensured that the door hook cannot be separated away from the door closing detection switch 15 and the position of the drawer door 2 is stable. As shown in FIGS. 6 and 7, when the drawer door 2 is in the open position, the position limiting block is stopped by the interlocking bracket 14, and thus the drawer door 2 is prevented from falling off and it is ensured that the position limiting block can touch the door opening detection switch 12. In some embodiments, the door hook may have substantially L shape, which is convenient for the door hook to be caught on the interlocking bracket 14 firmly.

In some embodiments as shown in FIGS. 2-5, the door closing detection switch 15 includes a monitoring switch 111, a primary switch 112 and a secondary switch 113 respectively communicating with the controller 43. When the drawer door 2 is in the closed position, the door closing touch configuration 22 touches the monitoring switch 111, the primary switch 112 and the secondary switch 113 respectively, and at this time, the controller 43 communicates with the driving device 3 to drive the driving device 3 to stop working. When the drawer door 2 is in the open position, the door closing touch configuration 22 releases the monitoring switch 111, the primary switch 112 and the secondary switch 113 respectively, which avoids affecting the communication between the controller 43 and the driving device 3, thus improving the safety of an electronic control.

In further embodiments of the present invention, a first primary switch 112*a* and a second primary switch 112*b* which are included in the primary switch 112 are provided, the monitoring switch 111 and the first primary switch 112*a* are disposed at a left side of the oven body 1, the secondary switch 113 and the second primary switch 112*b* are disposed at a right side of the oven body 1, and two door closing touch configurations 22 are provided and disposed at a left side and a right side of the drawer door 2 respectively. When the drawer door 2 is in the closed position, the door closing touch configuration 22 at the left side of the drawer door 2 touches the monitoring switch 111 and the first primary switch 112*a* respectively, and the door closing touch configuration 22 at the right side of the drawer door 2 touches the secondary switch 113 and the second primary switch 112*b* respectively. When the drawer door 2 is in the open position, the door closing touch configuration 22 at the left side of the drawer door 2 releases the monitoring switch 111 and the first primary switch 112*a* respectively, and the door closing touch configuration 22 at the right side of the drawer door 2 releases the secondary switch 113 and the second primary switch 112*b* respectively. Thus, the communication reliability of the controller 43 and the detection accuracy of the position of the drawer door 2 are improved.

Figure 3:
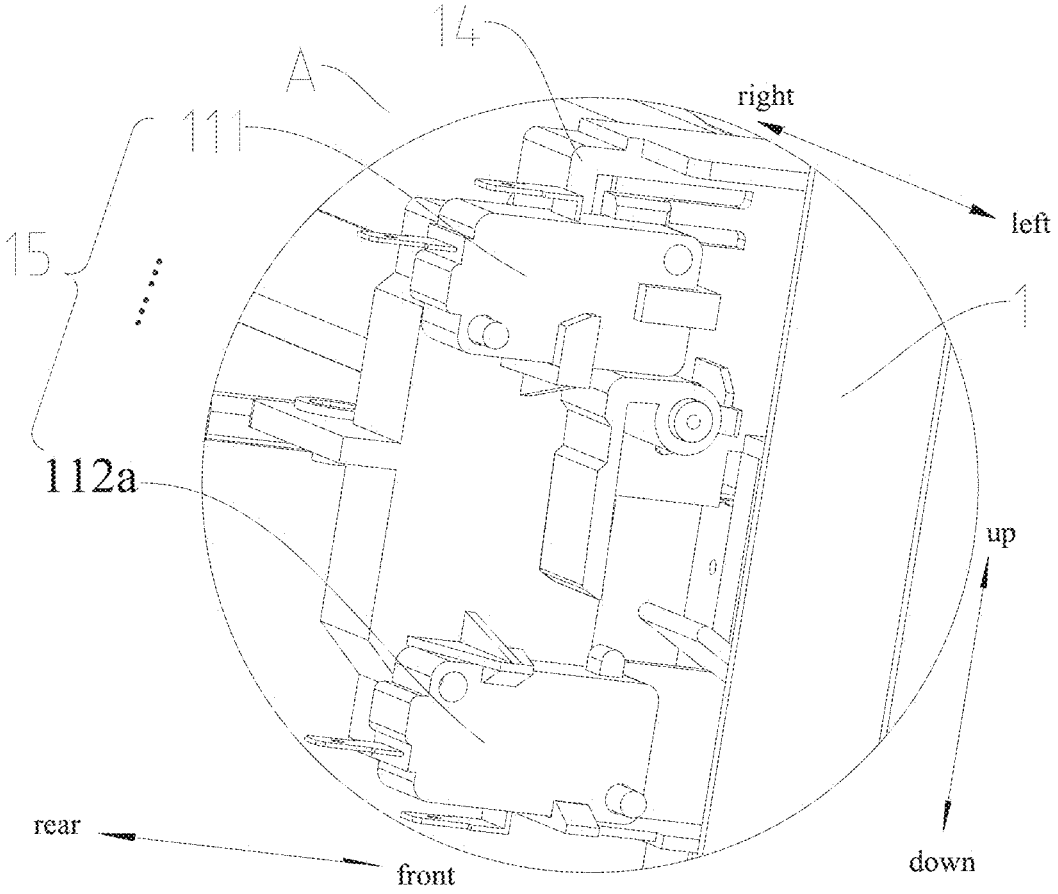
FIG. 3 is an enlarged view of portion A circled in FIG. 2.

In other words, as shown in FIGS. 3, 5 and 7, the monitoring switch 111 and the first primary switch 112*a* are disposed at the left side of the oven body 1, and the secondary switch 113 and the second primary switch 112*b* are disposed at the right side of the oven body 1, and the door hook is disposed at each of the left side and the right side of the drawer door 2. When the drawer door 2 is in the closed position, the door hook at the left side of the drawer door 2 touches the monitoring switch 111 and the first primary switch 112*a* at the left side of the oven body 1 respectively, and the door hook at the right side of the drawer door 2 touches the secondary switch 113 and the second primary switch 112*b* at the right side of the oven body 1 respectively. When the drawer door 2 is in the open position, the door hook at the left side of the drawer door 2 releases the monitoring switch 111 and the first primary switch 112*a* at the left side of the oven body 1 respectively, and the door hook at the right side of the drawer door 2 releases the secondary switch 113 and the second primary switch 112*b* at the right side of the oven body 1 respectively.

In some embodiments, as shown in FIGS. 2-7, the monitoring switch 111 and the first primary switch 112*a* at the left side of the oven body 1 are disposed horizontally, and the first primary switch 112*a* at the left side of the oven body 1 is located below the monitoring switch 111. The secondary switch 113 is disposed vertically, and the second primary switch 112*b* at the right of the oven body 1 is disposed horizontally and located below the secondary switch 113. In some embodiments, each of the monitoring switch 111, the primary switch 112, the secondary switch 113 and the door opening detection switch 12 is configured as a microswitch, so that the microwave heating device 100 has a simple control and a quick response.

As shown in FIG. 2, in an embodiment of the present invention, the driving device 3 includes an electric motor 31 and a push rod device 32. The electric motor 31 is installed at the bottom of the oven body 1 and communicates with the controller 43, so that when it needs to open or close the drawer door 2, the controller 43 can control the electric motor 31 to rotate forward or backward. The push rod device 32 is connected with the electric motor 31 and the drawer door 2 respectively and configured to transform a rotational movement of the electric motor 31 into a linear movement of the drawer door 2. Thus, when it needs to open the drawer door 2, the controller 43 communicates with the electric motor 31 and drives the electric motor 31 to rotate, and the rotational movement of the electric motor 31 is transformed into a forward movement of the drawer door 2 under an action of the push rod device 32, so as to open the drawer door 2. When it needs to close the drawer door 2, the rotational movement of the electric motor 31 is transformed into a backward movement of the drawer door 2 under the action of the push rod device 32, so as to close the drawer door 2.

Figure 9:
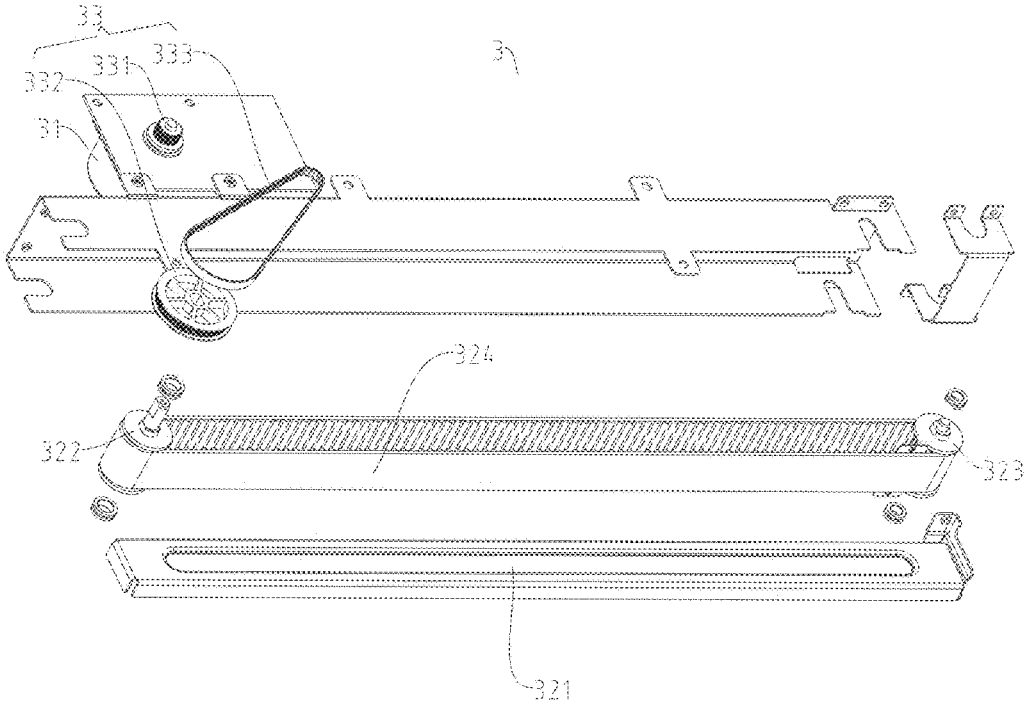
FIG. 9 is an exploded view of a driving device of a microwave heating device according to an embodiment of the present invention.

Furthermore, as shown in FIGS. 2 and 9, the push rod device 32 may include: a driving pulley 322, a driven pulley 323, a push rod drive belt 324 and a push rod 321. The driving pulley 322 and the driven pulley 323 are rotatably installed on the oven body 1 respectively, and the electric motor 31 is connected with the driving pulley 322 in a drive way. The push rod drive belt 324 is fitted over the driving pulley 322 and the driven pulley 323, and the electric motor 31 is configured to drive the driving pulley 322 to rotate so as to move the push rod drive belt 324, so that the push rod drive belt 324 drives the driven pulley 323 to rotate. The push rod 321 is connected with the push rod drive belt 324 and the drawer door 2 and driven by the push rod drive belt 324 to move linearly so as to move the drawer door 2 between the open positon and the closed position.

Figure 8:
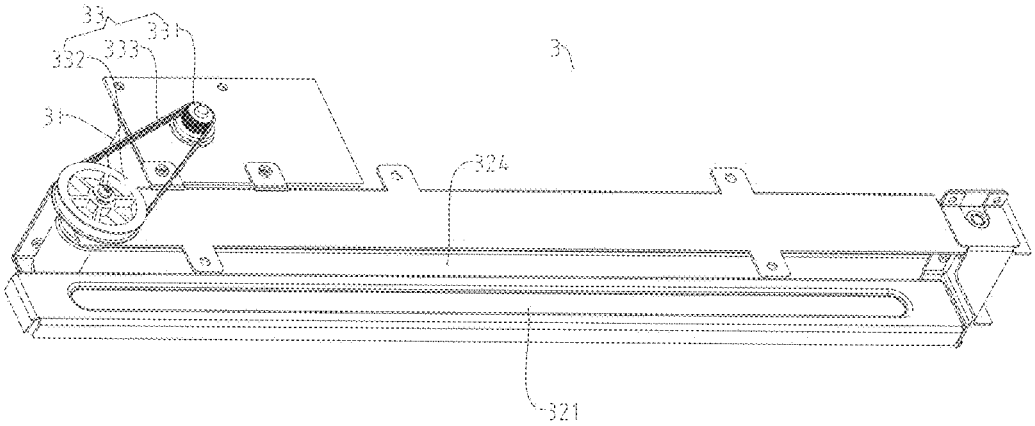
FIG. 8 is schematic view of a driving device of a microwave heating device according to an embodiment of the present invention.

In some embodiments, as shown in FIGS. 8 and 9, the driving device 3 further includes a variable-speed drive assembly 33 and the electric motor 31 is connected with the driving pulley 322 in a drive way by the variable-speed drive assembly 33. In this way, a rotation of the electric motor 31 can be transmitted to the driving pulley 322 by the variable-speed drive assembly 33, so that a rotating speed of the driving pulley 322 can be changed so as to adjust a moving speed of the drawer door 2.

Furthermore, as shown in FIGS. 8 and 9, the variable-speed drive assembly 33 may include: an electric motor pulley 331, a variable-speed pulley 332 and a variable-speed drive belt 333. The electric motor pulley 331 is connected with the electric motor 31 in a drive way. The variable-speed pulley 332 is connected with the driving pulley 322 in a drive way. The variable-speed drive belt 333 is fitted over the electric motor pulley 331 and the variable-speed pulley 332, so that the electric motor 31 drives the electric motor pulley 331 to rotate. The variable-speed drive belt 333 is driven by the electric motor pulley 331 to rotate the variable-speed pulley 332, so that the variable-speed pulley 332 drives the driving pulley 322 to rotate. By setting a dimension ratio of the electric motor pulley 331 to the variable-speed pulley 332, a variable-speed drive can be implemented.

A microwave heating device 100 according to a specific embodiment of the present invention will be described in details in the following with reference to the drawings. It may be understood that, the following descriptions only are exemplary, but not construed to limit the present invention.

As shown in FIGS. 1-9, the microwave heating device 100 according to the embodiment of the present invention includes an oven body 1, a drawer door 2, a driving device 3 and a controller 43.

Specifically, the oven body 1 has a microwave heating chamber 10 therein. A microwave emitter 5, a transformer 41, a capacitor 42 and a fan assembly 7 are disposed in a rear side of the oven body 1. The transformer 41 and the capacitor 42 are adapted to support the microwave emitter 5, and the fan assembly 7 is capable of dissipating heat of the microwave heating device 100. A waveguide tube 6 is disposed in a top of the oven body 1 and configured to guide the microwave into the microwave heating chamber 10. An interlocking bracket 14 is disposed at each of a left side and a right side of the oven body 1, a door closing detection switch 15 and a door opening detection switch 12 are installed on the interlocking bracket 14 and each of the door closing detection switch 15 and the door opening detection switch 12 is configured as a microswitch. The door closing detection switch 15 includes a monitoring switch 111, a primary switch 112 and a secondary switch 113. The monitoring switch 111 and the primary switch 112 are horizontally disposed on the interlocking bracket 14 at the left side, and the primary switch 112 is located below the monitoring switch 111. The secondary switch 113, the primary switch 112 and the door opening detection switch 12 are disposed on the interlocking bracket 14 at the right side, the secondary switch 113 is disposed vertically, and the primary switch 112 is disposed horizontally and located below the secondary switch 113 and above the door opening detection switch 12.

The drawer door 2 is disposed within the microwave heating chamber 10 and movable in a front and rear direction. A guiding rail 13 is fixed at each of the left side and the right side of the oven body 1, and correspondingly, a guiding rail connection plate 23 fitted with the guiding rail 13 is disposed at each of a left side and a right side of the drawer door 2, so that a sliding of the drawer door 2 can be supported. Also, a roller is fixed at a rear end of the drawer door 2 so as to facilitate an easy sliding of the drawer door 2. A control panel 24 is disposed at a front end of the drawer door 2, and buttons configured to control working conditions of the microwave heating device 100 are provided in the control panel 24. A door opening touch configuration 21 and a door closing touch configuration 22 are disposed on the drawer door 2. The door opening touch configuration 21 is configured as a position limiting block disposed at a rear end of the guiding rail connection plate 23 at the left side, and the door closing touch configuration 22 is configured as a door hook disposed at each of a left side and a right side of a rear surface of the drawer door 2.

The driving device 3 is installed at a bottom of the oven body 1 and includes an electric motor 31 and a push rod device 32. The push rod device 32 is configured to transform a rotational movement of the electric motor 31 into a front and rear movement of the push rod 321. In this way, the push rod device 32 is driven by the electric motor 31 and the push rod 321 is connected with the drawer door 2, and thus it only needs to press down a corresponding "open" or "close" button in the control panel 24 by the user to control the opening and closing of the drawer door 2. The controller 43 may be configured as a computer board in the rear side of the oven body 1 and communicate with the door opening detection switch 12, the door closing detection switch 15 and the driving device 3 respectively.

The door hook is disposed on the drawer door 2. When the drawer door 2 is closed, the door hook tightly grips the interlocking bracket 14, and then the microwave heating device 100 can cook the food.

When the microwave heating device 100 is in operation and the user presses down the "open" button in the control panel 24, the controller 43 sends out a signal to control the electric motor 31 to rotate forward after receiving a corresponding instruction, and the rotation of the electric motor 31 is transformed into a forward movement of the push rod 321 by the push rod device 32, so as to open the drawer door 2. When the drawer door 2 is opened and moved to a predetermined maximum travel, the position limiting block presses down the door opening detection switch 12, and then the door opening detection switch 12 feeds back a signal and the controller 43 determines that the drawer door 2 is opened in place, and thus the driving device 3 stops working and the drawer door 2 stops moving. After putting the food into the drawer door 2, the user presses down the "close" button in the control panel 24, and then the controller 43 sends out a signal to control the electric motor 31 to rotate backward and the push rod device 32 controls the push rod 321 to move backward so as to close the drawer door 2. After the drawer door 2 is closed, the door hooks at the left side and the right side touch the monitoring switch 111, the primary switch 112 and the secondary switch 113 on the interlocking bracket 14, and then the monitoring switch 111, the primary switch 112 and the secondary switch 113 feed back signals to the controller 43 and the controller 43 determines that the drawer door 2 is closed in place, and thus the driving device 3 stops working and the drawer door 2 stops moving. Then, the user can select a corresponding cooking function according to his own requirements.

With the microwave heating device 100 according to embodiments of the present invention, the position of the drawer door 2 is determined by using a mechanical positioning, and the drawer door 2 can be opened or closed automatically. Furthermore, the microwave heating device 100 according to embodiments of the present invention works reliably and has a simple structure, a low cost and a long working life.

In the specification, unless specified or limited otherwise, relative terms such as "up", "down", "front", "rear", "left", "right", "horizontal", "vertical", "top", "bottom", "inner", "outer", as well as derivative thereof should be construed to refer to the orientation as then described or as shown in the drawings under discussion for simplifying the description of the present invention, but do not alone indicate or imply that the device or element referred to must have a particular orientation, and be constructed or operated in a particular orientation. Thus, these terms shall not be construed to limit the present invention.

In the description of the present invention, unless specified or limited otherwise, it should be noted that, terms "mounted," "connected" and "coupled" may be understood broadly, such as permanent connection or detachable connection, electronic connection or mechanical connection, direct connection or indirect connection via intermediary, inner communication or interreaction between two elements. These having ordinary skills in the art should understand the specific meanings in the present invention according to specific situations.

Reference throughout this specification to "an embodiment," "some embodiments," "one embodiment", "another example," "an example," "a specific example," or "some examples," means that a particular feature, structure, material, or characteristic described in connection with the embodiment or example is included in at least one embodiment or example of the present invention. Thus, the appearances of the phrases such as "in some embodiments," "in one embodiment", "in an embodiment", "in another example," "in an example," "in a specific example," or "in some examples," in various places throughout this specification are not necessarily referring to the same embodiment or example of the present invention. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present invention, and changes, alternatives, and modifications can be made in the embodiments without departing from spirit, principles and scope of the present invention.

What is claimed is:

1. A microwave heating device, comprising:

an oven body defining a microwave heating chamber therein and provided with a door opening detection switch and a door closing detection switch;

a drawer door provided with a door opening touch configuration and a door closing touch configuration, installed on the oven body and movable between an open position in which the microwave heating chamber is opened and a closed position in which the microwave heating chamber is closed, wherein when the drawer door is in the open position, the door opening touch configuration touches the door opening detection switch and the door closing touch configuration releases the door closing detection switch; when the drawer door is in the closed position, the door closing touch configuration touches the door closing detection switch and the door opening touch configuration releases the door opening detection switch;

a driving device configured to drive the drawer door to move between the open position and the closed position, installed on one of the oven body and the drawer door and connected with the other one of the oven body and the drawer door in a drive way; and a controller configured to communicate with the door opening detection switch, the door closing detection switch and the driving device, wherein the door closing detection switch comprises a monitoring switch and a first primary switch disposed at a left side of the oven body, and a secondary switch and a second primary switch disposed at a right side of the oven body, wherein the door closing touch configuration comprises left door closing touch configuration disposed at a left side of the drawer door and right door closing touch configuration disposed at a right side of the drawer door, wherein when the drawer door is in the closed position, the left door closing touch configuration touches the monitoring switch followed by the first primary switch, and concomitantly, the right door closing touch configuration touches the secondary switch followed by the second primary switch, thereby sending feedback signal from the door closing detection switch to the controller, and wherein the controller receives the feedback signal that the drawer door is closed in place and communicates with the driving device to stop working, wherein when the drawer door is in the open position, the left door closing touch configuration releases the monitoring switch followed by the first primary switch, and concomitantly, the right door closing touch configuration releases the secondary switch followed by the second primary switch, until the door opening touch configuration touches the door opening detection switch thereby sending feedback signal from the door opening detection switch to the controller, and wherein the controller receives the feedback signal that the drawer door is opened in place and communicates with the driving device to stop working, wherein a guiding rail is disposed on the oven body, a guiding rail connection plate is disposed on the drawer door, and the guiding rail connection plate is movably fitted with the guiding rail;

wherein the door opening touch configuration is configured as a position limiting block disposed at the guiding rail connection plate, and the door closing touch configuration is configured as a door hook disposed at the drawer door.

2. The microwave heating device according to claim 1, wherein an interlocking bracket is disposed on the oven body, the door opening detection switch and the door closing detection switch are installed at the interlocking bracket, wherein when the drawer door is in the closed position, the door hook is caught on the interlocking bracket; when the drawer door is in the open position, the position limiting block is stopped by the interlocking bracket.

3. The microwave heating device according to claim 1, wherein the monitoring switch and the first primary switch are disposed horizontally, and the first primary switch is located below the monitoring switch; the secondary switch is disposed vertically, and the second primary switch is disposed horizontally and located below the secondary switch.

4. The microwave heating device according to claim 1, wherein each of the monitoring switch, the primary switch, the secondary switch and the door opening detection switch is configured as a microswitch.

5. The microwave heating device according to claim 1, wherein the driving device comprises:

an electric motor installed in the oven body and communicating with the controller;

a push rod device connected with the electric motor and the drawer door respectively and configured to transform a rotational movement of the electric motor into a linear movement of the drawer door.

6. The microwave heating device according to claim 5, wherein the push rod device comprises:

a driving pulley and a driven pulley rotatably installed on the oven body respectively, and the electric motor being connected with the driving pulley in a drive way;

a push rod drive belt fitted over the driving pulley and the driven pulley, and the electric motor be configured to drive the driving pulley to rotate so as to move the push rod drive belt;

a push rod connected with the push rod drive belt and the drawer door and driven by the push rod drive belt to move linearly so as to move the drawer door between the open positon and the closed position.

7. The microwave heating device according to claim 6, wherein the driving device further comprises a variable-speed drive assembly and the electric motor is connected with the driving pulley in a drive way by the variable-speed drive assembly.

8. The microwave heating device according to claim 7, wherein the variable-speed drive assembly comprises:

an electric motor pulley connected with the electric motor in a drive way;

a variable-speed pulley connected with the driving pulley in a drive way;

a variable-speed drive belt fitted over the electric motor pulley and the variable-speed pulley and driven by the electric motor pulley to rotate the variable-speed pulley.

* * * * *